United States Patent [19]

Hall et al.

[11] Patent Number: 4,807,701

[45] Date of Patent: Feb. 28, 1989

[54] METHOD FOR THERMAL STIMULATION OF A SUBTERRANEAN RESERVOIR AND APPARATUS THEREFOR

[75] Inventors: Dornese Hall, Houston, Tex.; Hung Q. Bui, Bakersfield, Calif.

[73] Assignee: Texaco Inc., White Plains, N.Y.

[21] Appl. No.: 87,372

[22] Filed: Aug. 20, 1987

[51] Int. Cl.[4] ..... B01F 3/04; E21B 36/00; E21B 43/24

[52] U.S. Cl. ..... 166/272; 166/90; 166/222; 166/57; 261/76; 261/DIG. 13; 261/DIG. 76

[58] Field of Search ..... 166/303, 272, 75.1, 166/57, 90, 222; 261/DIG. 13, DIG. 76, 76

[56] References Cited

U.S. PATENT DOCUMENTS

| | | | |
|---|---|---|---|
| 3,237,692 | 3/1966 | Wallace et al. | 166/303 |
| 4,011,287 | 3/1977 | Marley | 261/DIG. 13 X |
| 4,060,129 | 11/1977 | Gomaa et al. | 166/272 X |
| 4,071,586 | 1/1978 | Seger | 261/DIG. 13 |
| 4,130,611 | 12/1978 | Brand | 261/DIG. 13 X |

*Primary Examiner*—Stephen J. Novosad

*Attorney, Agent, or Firm*—Robert A. Kulason; James J. O'Loughlin; Robert B. Burns

[57] ABSTRACT

A system and the equipment for economically enhancing recovery of hydrocarbon fluids from a subterranean reservoir in which a plurality of production and injection wells are formed. High grade steam from a common source is mixed with relatively cold water at each injection well to be treated. To avoid, or substantially reduce condensation shock in the water/steam mixer, the high velocity cold water is initially heated in a steam compartment with minimal contact between the two fluids. Thereafter, the steam and the water are introduced to a heat exchange chamber in which the temperature of the water is raised prior to the two streams being merged for injection into a well as either heated water or as low quality steam.

13 Claims, 1 Drawing Sheet

METHOD FOR THERMAL STIMULATION OF A SUBTERRANEAN RESERVOIR AND APPARATUS THEREFOR

BACKGROUND OF THE INVENTION

The production of hydrocarbon fluids such as crude oil or gas from a subterranen reservoir is normally achieved by tapping into the reservoir with one or more wells from the surface. When the subterranean natural pressure is insufficient to force the hydrocarbon fluids to the surface, production can be stimulated or improved by the introduction of a thermal stimulant such as steam or hot water.

The primary effect of the latter, when introduced to a reservoir containing crude oil or the like, by way of an injection well, is to decrease the density of the heavy fluids. This change affords them greater mobility through the substrate. The less dense fluids can therefore be forced to the surface with minimal reservoir pressure.

This method of thermal stimulation particularly by steam or hot water injection, has long been utilized by the petroleum industry. It does, however, add an expense factor to the overall production costs, particularly in the instance of heavier crude oils.

A further factor bearing consideration occurs in the instance of older substerranean reservoirs or hydrocarbon containing fields. Over a period of time, thermal stimulation might become a necessary expedient if a production rate is to be sustained. It is therefore a general practice that to stimulate production, steam, regardless of its quality, is forced into the hydrocarbon containing reservoir thereby to increase or sustain a desired production rate.

Usually, the source of the steam for such a purpose is generated at a central location and piped to the well or to a plurality of wells at which it is to be used. The quality of the steam can be controlled at its source. However, since it is injected at a point of use remote from the steam generator, the quality will be decreased. This decrease in quality will to some degree be dependent on the distance, the efficiency of the steam conductor insulating medium, and phase splitting at pipe tests.

In the instance of large and diverse hydrocarbon containing fields, often numerous wells and well patterns are employed. In this situation, it has been found desirable and economical to regulate both the flow rate, and the quality of the steam which is utilized for any particular well or group of wells.

More specifically, in the instance of older wells, the quality and the flow rate of the injection steam need not be as high as the quality and flow rate of steam which is injected into newer wells. Thus, to epitomize the effective utilization of steam which is generated at a relatively high quality, it is necessary to reduce its quality and flow rate preferably at the point of use rather than at the point where it is generated.

In effect, high quality steam can be used most effectively and with minimal waste, by being introduced into a well that does not require such a degree of thermal stimulation. Rather, the well requires only a lower grade of steam to achieve a desired production rate.

Among the simpler methods for reducing the quality of any steam flow is to intermix water with the steam, thereby automatically reducing its quality. It is known, however, that the intermixing multiphase flow in this manner, where the temperature differentials of the two mediums are diverse, the reaction can be violent on the mixer or mixing equipment.

More specifically, it is known that at low steam flow rates the mixer will be subjected to severe vibration and shaking as a result of the intermixing of the steam with the water at a much lower temperature. This phenomenon is generally attributed to the violent condensation shock as the steam contacts cold water.

Unless the mixing equipment is made structurally adequate to overcome the violent reaction between the water and steam, damage could result especially where thermal stimulation through reduced quality steam is continuous over a period of time.

It is therefore an object of the invention to provide a system and the equipment therefor which is adapted to provide the necessary stimulating medium either in the form of low, or controlled quality steam or hot water, for injection into a hydrocarbon containing substrate.

A further object is to provide a simple steam-water mixer that will furnish an outflow of lowered quality steam and hot water without undue vibratory motion or shaking as a result of the mixing process.

DESCRIPTION OF THE DRAWINGS

Referring to FIG. 1, a hydrocarbon containing field 10 of the type contemplated is here shown and typified by two spaced apart production wells 11 and 12. These wells can represent a plurality of wells in a limited area. They could on the other hand represent for example hundreds of wells spread over a relatively large acreage which overlies a widespread, hydrocarbon containing reservoir.

Figure 1:
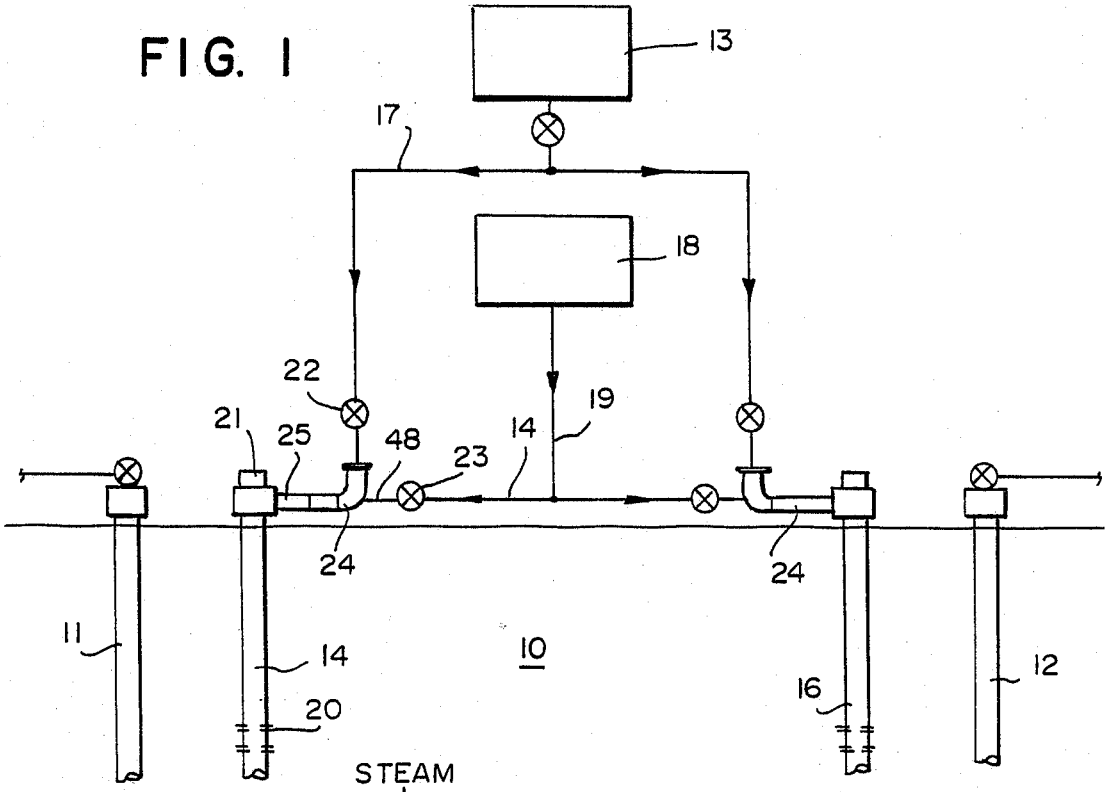
FIG. 1 is a schematic drawing illustrating a plurality of wells which are steam stimulated from a common source.

The field 10 is provided with a single steam generating source or unit 13 which is communicated with a supply of water, and is capable of forming a desired volume of steam at a known high quality.

Each of the producing wells 11 and 12 is provided with one or more injector wells 14 and 16 which are spaced from the production wells. Thus, the flow rate and movement of the hydrocarbon fluid toward a production well, can be regulated and stimulated by steam can be regulated and stimulated by steam injection into the substrate through particular injection wells.

In achieving the objectives of the invention, preferably each of the well heads at injections wells 14 and 16 is furnished with a predetermined flow rate of steam from source 13 at a known quality. At each individual well the steam is intermixed with a controlled amount of water to reduce the steam quality to the desired level for that particular well.

Operationally, and to achieve maximum efficiency, the high quality steam is conducted through pipeline 17 from the steam generator 13 to injector well 14. The latter is normally comprised of the usual external casing and internal tubing string, to a sufficient depth that the steam can be forced through casing perforations into the substrate 10 at a desired depth.

Concurrently, well 14 is communicated to a source of water 18. The latter as a matter of economy can be taken from a natural supply such as a remote stream and piped to the well, or from a suitable storage facility by way of line 19. The steam and water lines 17 and 19, respectively are each provided with the necessary valving 22 and 23 to regulate the flow rates, as well as the pressures at which the steam or the hot water enters mixer 24.

Each injector well, 14 for example, is further provided at its well head 15 with valving and necessary instrumentation 21 to make measurements whereby to monitor steam quality as the latter leaves steam mixer 24 and enters well 14 tubing to be conducted to the exit level at perforations 20.

Steam quality as a practical matter is determined through a suitable formula, comprised of data accumulated in response to the pressure and temperature of the steam and water being handled. Thus, the actual instrumentation 21 for determining steam quality at each well head 15 can be varied and assume a number of different embodiments to adequately serve the instant purpose.

As the reduced quality of the steam which is entering a particular well 14, is determined, that quality can be readily varied to conform to an optimum or predetermined quality which has been deemed to be most effective in that particular well or group of wells. Thus, the flow rate and the quality of the steam at each well 14 or group of wells, is subject to being tailored to match the conditions and production requirements at that particular well or group of wells.

Figure 2:
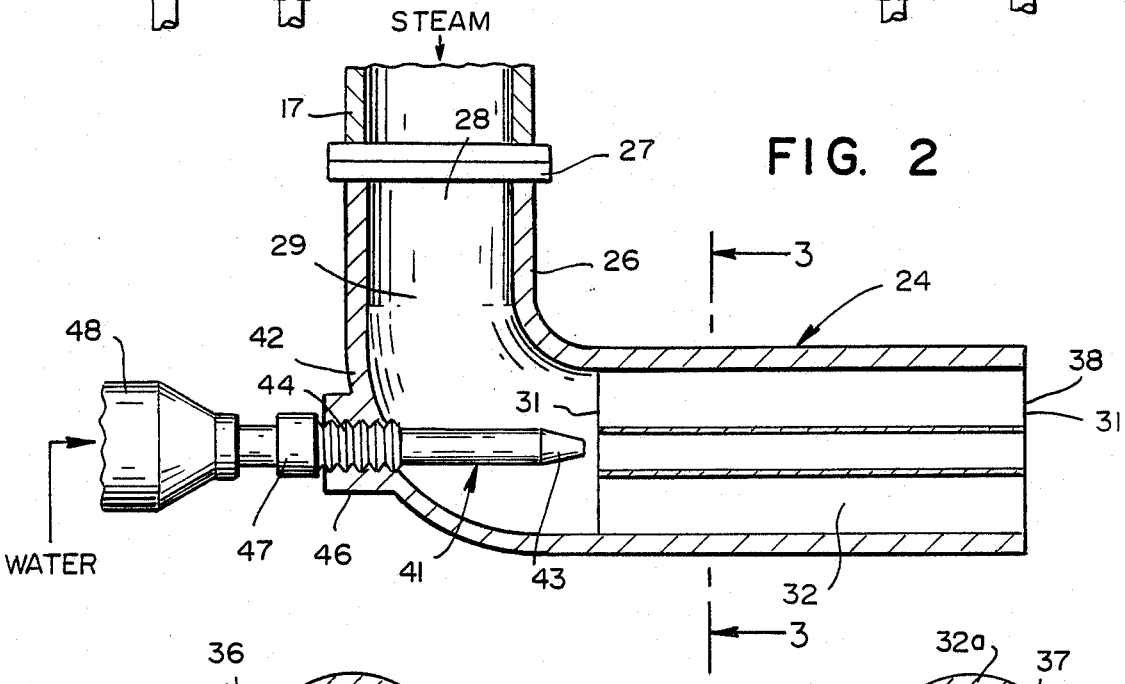
FIG. 2 is an elevation view in cross-section of a mixing apparatus of the type disclosed.

To achieve the mixing of water and steam in proportions to achieve the desired quality and water temperature, mixer 24 shown in FIG. 2 represents a preferred embodiment of the disclosed steam-water mixer. The latter is constructed to receive both water and steam flows in a manner to effectuate lowering of the steam quality, and raising of the water temperature.

Thus, the downstream side of mixer 24 will discharge steam into conductor 25 at a predetermined lower quality, as well as heated water, whether the latter is utilized for production stimulation or for other purposes. Further, the steam flow to mixer 24 can be introduced at regulated rates to contact cold water without the usual condensation shock occurring.

Referring to FIG. 2, steam/water mixer 24 is comprised of an upstream body 26 having a flange 27 or a similar facility for removably engaging a steam line 17 and valving 22 which is communicated with the primary source of the high quality steam 13. Body 26 is comprised preferably of a tubular elbow which as shown, has an open end and commences at inlet 28 whereby. inflowing high quality steam can be contacted with entering cold water.

Steam compartment 29 defined within said body 26, is curved toward the said compartment's end face 31 and terminates in an elongated heat exchange section 32.

Figure 3:
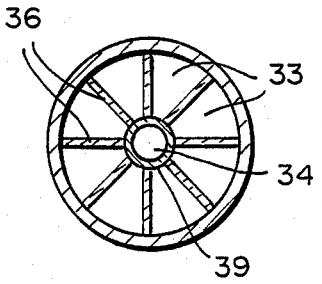
FIG. 3 is a cross-sectional view taken along line 3—3 in FIG. 2.

Heat exchange section 32 includes a tubular casing 35 which communicates with steam compartment 29, and preferably, as shown in FIG. 3, is provided with a plurality of discrete longitudinal passages 33 and 34. The latter can be formed in a number of ways including the use of a plurality of outwardly radiating vanes 36 which are fixed in place along the heat exchange inner wall. The vanes are connected at their inner end to a common cylinder 39.

Figure 4:
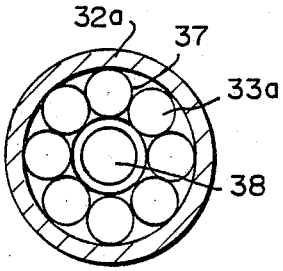
FIG. 4 is an alternate embodiment of a mixer apparatus similar to the apparatus shown in FIG. 3.

Heat exchange section 32 can also comprise, as shown in FIG. 4, a plurality of tubular members 37 which are so spaced and supported within the cylindrical body **32*a* to form a tubular bundle which defines a series of longitudinal heat exchange passages 33*a***.

Passages 37 are preferably arranged such that the central passage 38 receives a direct flow of incoming water. The outer heat exchange passages 33 receive the flow of incoming, high quality steam from the steam compartment 29.

referring to FIGS. 2 and 3, the heat exchanger section 32 thus functions to permit concurrent flow of cool water and high quality steam toward the downstream or discharge end 31 of the heat exchanger, from which the two streams emerge and combine. Since tee outlet 31 discharges relatively hot water into steam which has been cooled, there will be no violent reaction of the separate media as the streams come together.

Introduction of cooling water to mixer 24 is achieved by way of a jet or injector 41 which is removably received in a wall 42 of the steam compartment 29. As shown, jet 41 includes an elongated conductor segment, 45 which terminates at a constricted discharge nozzle 45.

Nozzle 45 as shown, is disposed coaxially of and contiguous with the inlet end or upstream end of the various longitudinal heat exchange passages 34. Thus, a high velocity stream of water which is introduced by way of the jet 41 to the steam compartment 29 experiences only momentary or brief contact with the high quality steam in compartment 29 thereby precluding substantial condensation of the water stream which could lead to condensation shock.

The elongated tubular body of water jet 41 disposed in steam compartment 29 will constitute an initial, though limited, heat exchange surface. Thus, incoming cold water will be initially heated to a minor degree as it flows to discharge nozzle 43.

To facilitate the proper mounting of water injector jet 41 within the steam compartment 29, said jet can be provided with a hub 44 which threadably engages a corresponding threaded pipe coupling 46 depending from the outer wall of body 26. Injector jet 41 includes an external collar 47 which is adapted to removably couple with a water carrying line 48.

To assure a desired flow rate of incoming water, and preferably to maintain the latter at a relatively high flow rate, the inlet collar 47 is reduced or constricted from the diameter of main steam carrying conduit 48.

Functionally, during the mixing period, water which is discharged from nozzle 43 will be initially heated by indirect heat exchange along the injector 41 length. However, as it leaves the nozzle 43 at a high velocity, the water stream will experience additional minimal contact with steam in steam compartment 29.

The low temperature water and the high temperature, high quality steam will then flow in concurrent streams along the heat exchange segment 32. The temperature and consequently the quality of steam discharged at the downstream end of the heat exchanger 32 will be reduced. Further, the temperature of the water exiting at outlet 38 will be raised to a temperature at which the two fluids can be intermixed without concern for condensation shock taking place.

As herein noted, the characteristics of incoming steam flow and water flow can be adjuisted by altering their respective control valves 22 and 23 upstream to mixer 24.

Mixing of the water and the steam is achieved as mentioned, without subjecting the mixer itself to severe condensation shock which would result from the intimate and direct contact between a low steam flow into the cold water. The mixer 24 is nonetheless formed of sufficiently heavy material, preferably steel, to accommodate the normal pressurized steam flow.

The vanes or the tubular members which constitute the longitudinal heat exchange passages 34 are formed of thin metallic walls capable of achieving the maximum degree of heat flow whereby to heat the flowing water as the latter moves through the body of the heat exchanger section.

At the downstream end of the latter, the steam and water can be further separated, or either one or both can be directed into the injector well to achieve the desired substrate heating function.

It is understood that although modifications and variations of the invention can be made without departing from the spirit and scope thereof, only such limitations should be imposed as are indicated in the appended claims.

We claim:

1. In a system for producing hydrocarbon fluids from a subterranean reservoir into which producing and injection wells are formed, and which subterranean reservoir requires thermal stimulation by way of at leas one of said injection wells to enhance the production of said hydrocarbon fluids form at least one of said producing wells, a pressurized source of high quality steam, a source of water having a temperature substantially lower than the temperature of the high quality steam, a fluid injection apparatus communicated with at least one of said injection wells and including means forming a steam compartment communicated with said pressurized source of high quality steam to receive a controlled flow thereof, means forming a heat exchange chamber comprised of discrete longitudinal passage means having an stream end communicated with said means forming said stem compartment to receive high quality steam therefrom, and having downstream discharge openings, a fluid injector having an inlet communicated with said source of water, a discharge nozzle opening into said means forming said steam compartment, and being positioned in alignment with the upstream end of the discrete longitudinal heat exchange passage means, and conduit means communicating said means forming said heat exchange chamber downstream end with an injection well, to introduce low quality stem and/or heated water from said means forming said heat exchanger downstream end, into said injection well.

2. In the system as defined in claim 1, including means for regulating the flow of high quality steam form the source thereof, to said means forming said steam compartment.

3. In the system as defined in claim 1, wherein said means forming a plurality of discrete elongated passages in comprises a tube bundle.

4. In the system as defined in claim 1, wherein said fluid injection nozzle outlet is positioned contiguous with the stream end of at least some of said plurality of discrete heat exchange passages.

5. A condensation shock resistant fluid mixer for receiving streams of high quality steam from respectively, for producing low quality steam and heated water, which apparatus includes means forming a steam compartment having an inlet for communication with said high quality steam source, means forming a heat exchange chamber including a plurality of discrete passage means which open into said means forming a steam compartment, and which terminate at a downstream aperture, a later injector engageable with said water source and having a discharge nozzle opening into said steam department, said discharge nozzle being disposed contiguous with and in alignment with said plurality of discrete passages to receive a stream of water therefrom.

6. Method for producing hydrocarbon liquid from a subterranean reservoir in which said hydrocarbon liquid is obtained, which reservoir is penetrated by a plurality of hydrocarbon producing wells and injection wells for introducing a hot fluid of low quality into said reservoir, to thermally stimulate said production which method includes the steps of providing a source of high quality steam, providing each said injector well with a multi-fluid mixing apparatus having a discharge port which communicates with said injection well, introducing to each fluid mixing apparatus streams of said high quality steam, and cold water, conducting the respective high quality steam and water in heat exchange contact to said discharge port for introducing a low quality thermal stimulant to said injection well.

7. In the apparatus as defined in claim ,, wherein said water injector includes means to adjustably regulate the spacing of the discharge nozzle from said plurality of discrete passages.

8. In the apparatus as defined in claim 5, mixer to rotatably adjust the aligned positioned of said nozzle with respect to said plurality of discrete passages.

9. In the apparatus as defined in claim 5, wherein said means forming said heat exchange chamber includes means forming a first elongated central passage, and a plurality of discrete means forming passages positioned circumferentially thereabout.

10. In the apparatus as defined in claim 9, wherein said injector discharge nozzle is positioned contiguous with, and in axial alignment, with said first elongated central passage.

11. In the apparatus as defined in claim 5, wherein said mixer includes a tubular casing communicated forming said plurality of discrete passages being positioned in said tubular casing.

12. In the apparatus as defined in claim 11, wherein said means forming said plurality of discrete passages is comprised of a tube bundle.

13. In the apparatus as defined in claim 12, wherein said means forming said plurality of discrete passages is comprised of a central tubular member, and a plurality of vanes connected thereto and extending outwardly the tubular casing.

* * * * *

UNITED STATES PATENT AND TRADEMARK OFFICE

CERTIFICATE OF CORRECTION

PATENT NO. : 4,807,701

DATED : February 28, 1989

INVENTOR(S) : Dornese Hall; Hung Q. Bui

It is certified that error appears in the above—identified patent and that said Letters Patent is hereby corrected as shown below:

Column 5, line 41, change "stream" to --upstream--; line 42, change "stem" to--steam--; line 58, change "form" to --from--; line 63, cancel --in--.

Column 6, line 1, change "stream" to --upstream--; line 14, change "later" to --water--; line 16, change "department" to --compartment--; line 37, after "claim" insert --5--; line 41, after "5" insert --wherein said water injector is threadably mounted in said--; line 42, change "positioned" to --positioning--; line 54, after "communicated" add --with said means forming said steam compartment, said means--; line 63, after "outwardly" insert --to--.

Signed and Sealed this

Twenty-sixth Day of September, 1989

*Attest:*

DONALD J. QUIGG

*Attesting Officer*

*Commissioner of Patents and Trademarks*